US009296969B2

(12) United States Patent
DeBlase et al.

(10) Patent No.: US 9,296,969 B2
(45) Date of Patent: Mar. 29, 2016

(54) FATTY SORBITAN ESTER BASED FRICTION MODIFIERS

(71) Applicants: Frank J. DeBlase, Hopewell Junction, NY (US); Cyril A. Migdal, Pleasant Valley, NY (US); Gerard Mulqueen, Watertown, CT (US); Venkatramanan K. Madabusi, Naugatuck, CT (US)

(72) Inventors: Frank J. DeBlase, Hopewell Junction, NY (US); Cyril A. Migdal, Pleasant Valley, NY (US); Gerard Mulqueen, Watertown, CT (US); Venkatramanan K. Madabusi, Naugatuck, CT (US)

(73) Assignee: Chemtura Corporation, Middlebury, CT (US)

( * ) Notice: Subject to any disclaimer, the term of this patent is extended or adjusted under 35 U.S.C. 154(b) by 0 days.

(21) Appl. No.: 14/103,892

(22) Filed: Dec. 12, 2013

(65) Prior Publication Data

US 2015/0166922 A1 Jun. 18, 2015

Related U.S. Application Data

(62) Division of application No. 12/371,872, filed on Feb. 16, 2009, now abandoned.

(51) Int. Cl.

| | |
|---|---|
| ***C10M 105/22*** | (2006.01) |
| ***F16C 1/24*** | (2006.01) |
| ***C10M 171/00*** | (2006.01) |
| ***C10M 129/76*** | (2006.01) |

(52) U.S. Cl.

CPC ..... *C10M 129/76* (2013.01); *C10M 2207/283* (2013.01)

(58) Field of Classification Search

CPC ..... C10M 5/00; C10M 7/00; C01N 2050/10; C01N 2050/00

USPC ..... 508/100, 101; 210/348, 416.15

See application file for complete search history.

(56) References Cited

U.S. PATENT DOCUMENTS

| | | | | |
|---|---|---|---|---|
| 2,788,326 | A | 4/1957 | Bondi et al. | |
| 4,304,678 | A | 12/1981 | Schick et al. | |
| 2002/0016266 | A1 * | 2/2002 | Fletschinger et al. | 508/433 |
| 2003/0000866 | A1 | 1/2003 | Cain | |
| 2003/0008961 | A1 | 1/2003 | Uematsu | |
| 2003/0186824 | A1 | 10/2003 | Chiu et al. | |
| 2004/0127369 | A1 | 7/2004 | Belot | |
| 2005/0198894 | A1 * | 9/2005 | Migdal et al. | 44/388 |
| 2006/0183647 | A1 | 8/2006 | Kocsis et al. | |
| 2006/0217275 | A1 * | 9/2006 | Imai et al. | 508/321 |
| 2007/0049505 | A1 | 3/2007 | Baker et al. | |
| 2010/0210487 | A1 * | 8/2010 | Deblase et al. | 508/100 |

OTHER PUBLICATIONS

P & G Chemical Tallow fatty acids http://www.pgchemicals.com/resources/specsheets/NA-Tallow-Stearic_Oleic-072605.pdf available online Nov. 7, 2007).*

Polysorbate 60 Jeen International Corp (available online on and beofre Feb. 14, 2008).*

Polysorbate 65 Jeen International Corp. (available online on and beofre Feb. 14, 2008).*

P & G Chemical Tallow Fatty Acids, www.pgchemical/resources/sspecheets/NA-Tallow-Stearic_Oliec-072605.pdf (Nov. 7, 2007).

Polysorbate 60 Jeen International Corp (on and before Feb. 14, 2008).

Polysorbate 65 Jeen International Corp (on and before Feb. 14, 2008).

* cited by examiner

*Primary Examiner* — Pamela H Weiss

(74) *Attorney, Agent, or Firm* — Dilworth IP, LLC

(57) ABSTRACT

A friction modifier composition for reducing friction in a lubricant comprising a fatty acid sorbitan ester that is solid or semi-solid. The fatty acid sorbitan ester is capable of being released into a lubricant at a rate of less than or equal to 0.15 grams per minute.

7 Claims, 2 Drawing Sheets

FATTY SORBITAN ESTER BASED FRICTION MODIFIERS

This patent application is a divisional of U.S. patent application Ser. No. 12/371,872, filed Feb. 16, 2009, the contents of which are incorporated herein by reference.

The present invention relates to friction modifiers for use in lubricants. More specifically, the invention relates to the use of fatty acid sorbitan ester based friction modifiers that are solid or semi-solid.

BACKGROUND OF THE INVENTION

Engines and their associated parts use lubricants, such as oil, to facilitate the movement of internal components and improve and/or lengthen their respective working lifetimes. These lubricants, along with various additives, possess a number of different lubricating properties, such as properties for reducing soot/sludge formation, corrosion or oxidation, reducing friction, thermal decomposition, extreme pressure and wear, etc. Generally, over the lifetime of a lubricant, additives in the lubricants deplete and/or change form, thus reducing their effectiveness. As a result, over time, lubricants degrade and ultimately must be replaced.

Time release additives for lubricants may be useful to supplement and/or provide additional lubricating properties to lubricant compositions, thereby extending their useful lifetime. Some slow release lubricant additives are known and, for example, may be utilized in oil filters. Such additives may be incorporated into thermoplastic polymers, for example, which slowly dissolve into the oil being processed by the filter. Examples of such additives are disclosed in U.S. Pat. No. 4,075,098, the entirety of which is incorporated herein by reference. Other additives may be incorporated into polymers, which are oil-permeable at elevated engine temperatures. Examples of such additives are disclosed in U.S. Pat. No. 4,066,559, the entirety of which is incorporated herein by reference. Still other additives are incorporated into particles which are oil-insoluble but oil-wettable. Examples of such additives are disclosed in U.S. Pat. No. 5,478,463, the entirety of which is incorporated herein by reference.

In another approach, oil-soluble solid polymers capable of functioning as viscosity improvers are provided inside an oil filter, with or without additional additives being incorporated into the polymer. Examples of such additives are disclosed in U.S. Pat. No. 4,014,794, the entirety of which is incorporated herein by reference. Although these systems are capable of introducing lubricant additives into the oil being filtered, they typically require inert carriers for slow release of the additives into the oil.

In addition, U.S. Pat. No. 7,384,896, the entirety of which is incorporated herein by reference, discloses additive gels that can provide additives to a functional fluid over time. The additive gel comprises i.) at least two additives selected from the group comprising detergents, dispersants, acids, bases, over based detergent, succinated polyolefins or mixtures thereof wherein the selected additives when combined form a gel; ii.) optionally at least one additive comprising viscosity modifier(s), friction modifier(s), detergent(s), cloud point depressant(s), pour point depressant(s), demulsifier(s), flow improver(s), anti static agent(s), dispersant(s), antioxidant(s), antifoam(s), corrosion/rust inhibitor(s), extreme pressure/antiwear agent(s), seal swell agent(s), lubricity aid(s), antimisting agent(s), and mixtures thereof; resulting in a controlled release gel that over time releases at least one desired additive into a functional fluid when the gel is contacted with the functional fluid.

Also, U.S. Pat. No. 7,417,012, the entirety of which is incorporated herein by reference, discloses a lubricant additive gel formed by the gellation of two or more lubricant additives for the slow release of the additive components into a fluid. The lubricant additive gel slowly releases into its component lubricant additives when contacted with the fluid such as an oil thereby serving as a lubricant fluid such as an oil.

U.S. Publication No. 2006/0079413, the entirety of which is incorporated herein by reference, discloses formulations using tartaric compounds in a low sulfur, low ash and low phosphorous lubricant to lower wear, and friction and improve fuel economy.

U.S. Publication No. 2007/0004601, the entirety of which is incorporated herein by reference, discloses a release additive composition including at least one overbased detergent present in a form chosen from a solid and a semi-solid. Also disclosed is a lubrication system and a method of improving the drain interval of oil.

U.S. Publication No. 2007/0004604, the entirety of which is incorporated herein by reference, discloses a release additive composition including at least one dispersant viscosity index improver present in a form chosen from a semi-solid and a solid.

In addition, U.S. Publication No. 2007/0049505, the entirety of which is incorporated herein by reference, discloses a method of lubricating containing: (a) employing a first functional fluid, (b) adding or contacting the first functional fluid with a controlled release gel wherein the controlled release gel has the desired additives to be released imparting the desired properties into the first functional fluid which is for lubricating a mechanical device; and/or adding a delivery system with the desired additives for a second functional fluid; (c) releasing the desired additives from the delivery system into the first functional fluid resulting in the first functional fluid changing into a second functional fluid, with the proviso that the second functional fluid is different from the first functional fluid.

U.S. Publication No. 2008/0015126, the entirety of which is incorporated herein by reference, discloses a control release gel for delivery of additives free of producing ash to substantially free of producing ash into a lubricant.

Finally, U.S. Publication No. 2008/0108531, the entirety of which is incorporated herein by reference, discloses the use of viscosity modifiers in a control release additive gel containing a viscosity modifier that control releases additives into a lubricant.

Even in view of the above-described lubricant additives, the need remains for effective additives, e.g., effective friction modifier additives, that can be released, optionally controllably released, into a lubricant to replenish and/or enhance the lubricating properties of the lubricant that otherwise may be reduced over time.

SUMMARY OF THE INVENTION

In one aspect, the present invention relates to friction modifier compositions for reducing friction in lubricants. The friction modifier compositions comprise fatty acid sorbitan esters, e.g., $C_8$ or greater fatty acid sorbitan esters such as tallow sorbitan esters, that are solid or semi-solid. In use, as the solid or semi-solid fatty acid sorbitan ester is contacted by a lubricant, the fatty acid sorbitan ester is released into the lubricant, preferably over an extended period of time. As such, the inventive composition adds and/or supplements the lubricant with fatty acid sorbitan ester additive at a controlled rate. In another aspect, the present invention relates to a friction modifier composition that comprises the inventive fatty acid sorbitan esters, discussed above, and at least one additional additive.

In another aspect, the present invention relates to a lubricant composition. The lubricant composition may comprise a base lubricant, e.g., a base stock, and the inventive fatty acid sorbitan ester composition. As the fatty acid sorbitan ester compositions are gradually blended with the base stocks, the lubricating properties of the base stock that typically decrease over time are replenished with the fatty acid sorbitan esters. Thus, the newly introduced fatty acid sorbitan ester provides supplemental lubricating properties that preferably balance the properties lost by the lubricant over time.

In another embodiment, the invention is to a process for improving the friction reducing ability of a lubricant. The inventive process comprises the step of releasing, e.g., gradually releasing, into the lubricant a $C_8$ or greater fatty acid sorbitan ester from a solid or semi-solid fatty acid sorbitan ester composition. As noted above, the gradual rate of release of fatty acid sorbitan ester composition into the lubricant replenishes the lubricating properties of the lubricant that are lost over time. In a preferred embodiment, the rate of release of fatty acid sorbitan ester into the base stock is not greater than 0.5 grams per minute, e.g., not greater than 0.15 grams per minute.

In another embodiment, the invention is to a device for providing fatty acid sorbitan ester additives to a lubricant. The device includes a $C_8$ or greater fatty acid sorbitan ester that is solid or semi-solid and a containiner for holding the fatty acid sorbitan ester, the container being configured to allow the lubricant to flow therethrough. The device is preferably configured to allow the lubricant to pass over and/or through the fatty acid sorbitan ester causing the fatty acid sorbitan ester to be released into the lubricant

BRIEF DESCRIPTION OF THE DRAWINGS

The present invention will be better understood in view of the appended non-limiting Figures, in which.

DETAILED DESCRIPTION OF THE PREFERRED EMBODIMENTS

Figure 1:
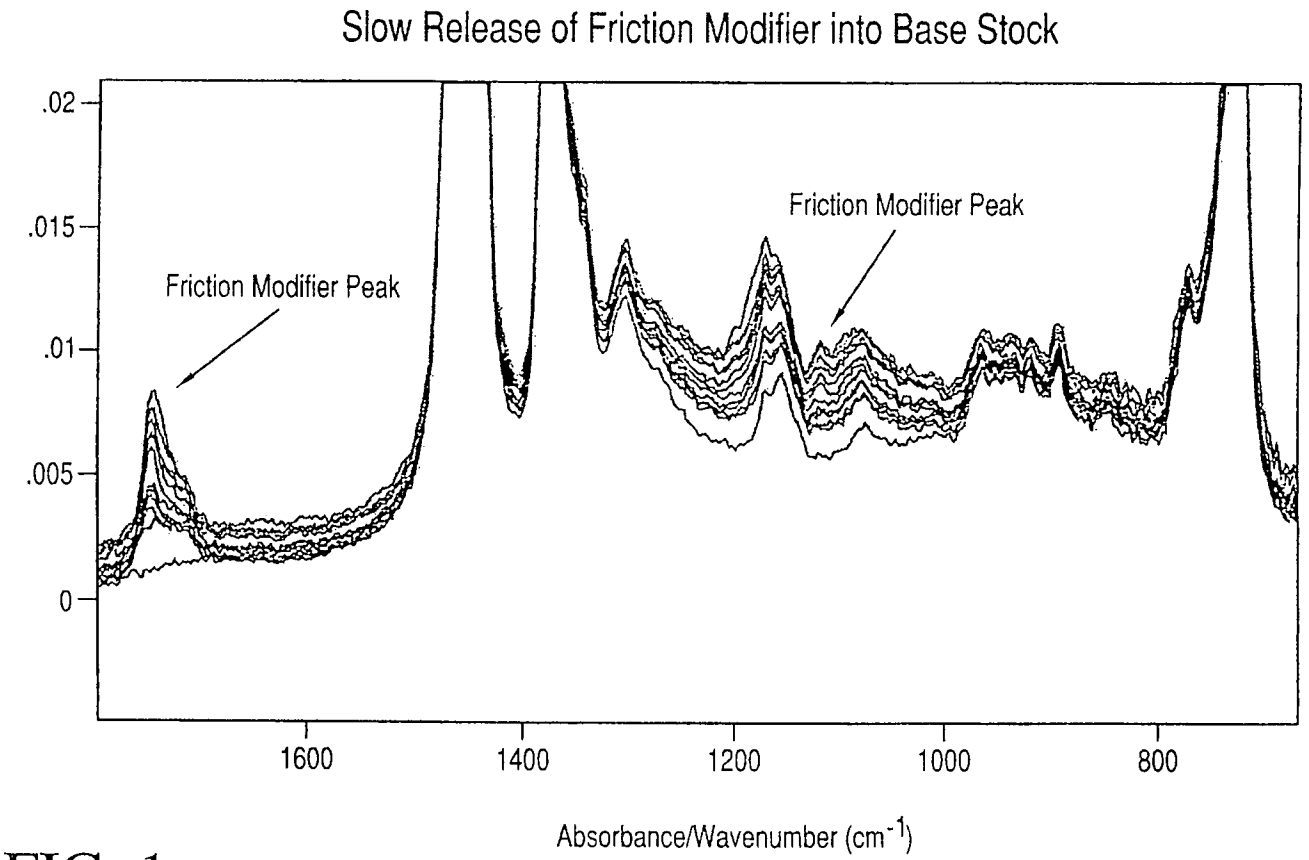
FIG. 1 is a graph showing FT-IR spectra of a lubricant comprising tallow fatty acid sorbitan ester monitored over time.

The present invention relates to improving the friction reducing ability of lubricants. In particular, the invention relates to the use of fatty acid sorbitan esters, e.g., tallow sorbitan esters (TSEs), which may be released, optionally controllably released or slowly released, over extended periods of time into the lubricants such that one or more properties of the lubricants, e.g., the lubricating properties or friction reducing properties, are (i) improved, (ii) substantially maintained or (iii) reduced more slowly over time than they would in the absence of the fatty acid sorbitan esters.

Typically, lubricant base stocks and additives that are initially added to lubricant base stocks deteriorate over the lubricant lifetime. Thus, the lubricating properties of lubricants tend to decrease over time. Some time release additives have been used to slowly provide additives to lubricants. The effectiveness of some of these time release additives, however, leaves room for improvement. In addition, many additives that may be suitable friction modifiers do not gel sufficiently and/or do not lend themselves to being controllably released. The compositions, processes and devices of the present invention may be used to supplement lubricants with effective additives, e.g., effective friction reduction additives, over time, thus countering the depletion of lubricating properties caused by the normal deterioration of the lubricant base stocks and/or their additives. As a result, the lubricating properties of lubricants may be beneficially improved, maintained and/or reduced more slowly thereby improving the overall effective lifetime of such lubricants and the equipment in which they are utilized.

Fatty Acid Sorbitan Esters

One preferred embodiment of the present invention relates to a friction modifier additive composition for reducing friction in a lubricant. The friction modifier additive (also referred to herein as a "fatty acid sorbitan ester" or "fatty acid sorbitan ester composition") comprises a fatty acid sorbitan ester, optionally a tallow sorbitan ester, that is solid, substantially solid or semi-solid.

For the purposes of this specification, the term "solid" refers to a composition having: (1) a Brookfield viscosity greater than 5,000 cP at 100° C., e.g., greater than 10,000 cP at 100° C., greater than 30,000 cP at 100° C., greater than 40,000 cP at 100° C. or greater than 50,000 cP at 100° C.; and/or (2) an ASTM D 2240-45 Type D Durometer Reading greater than 20, e.g., greater than 25, greater than 30, greater than 35, greater than 45, greater than 50 or greater than 55. For the purposes of this invention, the term "semi-solid" refers to a composition having: (1) a Brookfield viscosity greater than 5,000 cP at at 25° C., e.g., greater than 10,000 cP at 25° C., greater than 15,000 cP at 25° C. or greater than 20,000 cP at 25° C.; and/or (2) an ASTM D 2240-45 Type D Durometer Reading less than 45, e.g., less than 40, less than 35, less than 30, less than 25 or less than 20; and/or (3) an ASTM D 2240-45 Type A Durometer Reading greater than 0, e.g., greater than 0.1, greater than 0.5, greater than 1.0 or greater than 5. In preferred embodiments, the semi-solid fatty acid sorbitan ester has a Brookfield viscosity ranging from 1 cP to 50,000 cP, e.g., from 100 cP to 40,000 cP, from 100 cP to 20,000 cP, from 100 cP to 8,000 cP, from 1,000 to 7,000 cP or from 1,000 cP to 5,000 cP at 25° C. Unless otherwise indicated, the viscosities referred to in this specification are determined by a Brookfield Viscometer, e.g., the viscosities are Brookfield viscosities, and are measured at ambient temperature unless a different temperatures is specified.

In use, as the solid fatty acid sorbitan ester or semi-solid fatty acid sorbitan ester is contacted by a lubricant, the fatty acid sorbitan ester is released, preferably dissolved, into the lubricant, thereby adding and/or supplementing the lubricant with fatty acid sorbitan ester. In one embodiment, the solid or semi-solid (gel) state of the fatty acid sorbitan ester allows the fatty acid sorbitan ester to be released, e.g., controllably released at a specified release rate, into a lubricant over an extended period of time, for example, over more than a day, over more than a week, over more than a month or over more than a year. In one embodiment, the viscosity of the fatty acid sorbitan ester composition is inversely proportional to the release rate into the lubricant. That is, as the viscosity of the fatty acid sorbitan ester increases, the accompanying release rate will decrease.

The fatty acid sorbitan ester compositions of the present invention lend themselves particularly well to gelation and/or solidification and/or to controlled release into a lubricant due to the hydrophilic chains provided by the fatty acid moiety of the molecules. The viscosities of the inventive fatty acid sorbitan ester compositions can be formulated to suit particular applications. In preferred embodiments, the fatty acid sorbitan ester composition has a Brookfield viscosity of at least about 100 cP, e.g., at least about 1,000 cP, at least about 5,000 cP, at least about 10,000 cP, at least 15,000 cP, at least 20,000 cP, at least 25,000 cP or at least about 30,000 cP, at 25° C. In terms of ranges, the fatty acid sorbitan ester optionally has a Brookfield viscosity in the range of from about 1 cP to about 100,000 cP, e.g., from about 1,000 cP to about 75,000 cP, from about 5,000 cP to about 60,000 cP, from about 10,000 cP to about 50,000 cP, or from about 10,000 cP to about 40,000 cP, at 25° C. In other preferred embodiments, the Brookfield viscosity of the fatty acid sorbitan ester composition is at least about 5 cP, at least about 10 cP, at least about 20 cP, at least about 100 cP, at least about 500 cP, at least about 1,000 cP, at least about 5,000 cP or at least about 10,000 cP at 100° C. In terms of ranges, the fatty acid sorbitan ester optionally has a Brookfield viscosity ranging from about 1 cP to about 50,000 cP, e.g., from about 5 cP to about 40,000 cP, from about 10 cP to about 35,000 cP or from about 20 cP to about 30,000 cP, at 100° C.

In utilizing the benefits of the hydrophilic fatty acid chains, such viscous fatty acid sorbitan ester compositions are able to release into the respective lubricant at slow and/or controlled rates. In various preferred embodiments, the release rate into the lubricant is not greater than about 0.5 grams per minute, e.g., not greater than about 0.15 grams per minute, not greater than about 0.10 gram per minute, not greater than about 0.075 grams per minute, not greater than about 0.05 grams per minute, not greater than about 0.03 grams per minute, not greater than about 0.025, not greater than about 0.01 grams per minute or not greater than 0.0025 grams per minute. In terms of ranges, the release rate optionally ranges from about 0.0001 to about 0.5 grams per minute, e.g., from about 0.0025 to about 0.15 grams per minute, from about 0.01 to about 0.15 grams per minute, from about 0.01 to about 0.1 grams per minute, from about 0.01 to about 0.05 grams per minute or from about 0.01 to about 0.025 grams per minute. In one embodiment, such release rates are achieved at temperatures ranging from about 25° C. to about 180° C., e.g., from about 50° C. to about 170° C., from about 70° C. to about 150° C., or from about 90° C. to about 130° C. In one embodiment, such release rates are achieved at about 95° C. Such fatty acid sorbitan ester compositions surprisingly and unexpectedly have been found to function well as friction modifiers that effectively release into lubricants at controlled rates, e.g., slow rates.

Various fatty acid sorbitan esters and/or mixtures of fatty acid sorbitan esters may be utilized in the present invention. In preferred embodiments, the fatty acid sorbitan ester comprises (or the fatty acid sorbitan esters comprise) a $C_4$ or greater fatty acid sorbitan ester, e.g., a $C_6$ or greater fatty acid sorbitan ester, a $C_8$ or greater fatty acid sorbitan ester, a $C_{10}$ or greater fatty acid sorbitan ester, a $C_{12}$ or greater fatty acid sorbitan ester or a $C_{14}$ or greater fatty acid sorbitan ester. The fatty acid sorbitan esters comprise a fatty acid moiety. By "$C_n$ or greater fatty acid sorbitan ester" it is meant that the fatty acid moiety contains at least n carbon atoms, including the ester carbon atom. Thus, by "$C_8$ or greater fatty acid sorbitan ester," it is meant that the fatty acid moiety contains at least 8 carbon atoms. Generally speaking, in terms of ranges, the number of carbon atoms in the fatty acid moiety ranges from 4 to 28 carbon atoms, e.g., from 6 to 28 carbon atoms, from 8 to 22 carbon atoms, from 10 to 20 carbon atoms or from 12 to 18 carbon atoms. In some preferred embodiments, the fatty acid sorbitan ester may comprise a tallow sorbitan ester and/or a coconut sorbitan ester.

The fatty acid sorbitan ester compositions of the present invention may be characterized by their hardness. Hardness may be determined, as discussed above for example, under ASTM D-2240-45, which may utilize a Type A or Type D Shore Durometer. In a preferred embodiment, the fatty acid sorbitan ester compositions of the present invention have a Type A hardness of at least about 0.05, e.g., at least about 0.1, at least about 0.25, at least about 0.5, at least about 1, at least about 5, at least about 10, at least about 50, at least about 94 or at least about 100. In terms of ranges, the hardness of the fatty acid sorbitan ester compositions may range from 0.05 Type A to 100 Type D, e.g., from 0.25 Type A to 50 Type D, from 0.5 Type A to 40 Type D or from 5 Type A to 5 30 Type D, as measured under ASTM D-2240-45. The terms "Type A" and "Type D" refer to the hardness measured on a Type A or Type D Durometer, respectively.

As noted above, the fatty acid sorbitan ester compositions of the present invention are particularly effective friction modifiers. That is to say, the fatty acid sorbitan ester compositions possess the ability to reduce friction in a lubricant to which the fatty acid sorbitan ester composition is added. In one embodiment, the effectiveness of friction modification is measured via a Cameron Plint TE 77 High Frequency Friction Test testing procedure. The Cameron Plint testing procedure quantifies the coefficient of friction of the lubricant into which an additive is released. In a preferred embodiment, the fatty acid sorbitan ester compositions reduce the coefficient of friction of the respective lubricant by at least 10%, e.g., at least 20%, at least 30% or at least 40%, as measured at temperatures above 25° C., e.g., above 40° C. or above 60° C. In other embodiments, the reduced friction performance is indicated by a reduction in average wear scar of greater than 25%, e.g., greater than 35%, greater than 50% or greater than 60%, as measured by Cameron Plint Wear, Falex Four Ball Wear and/or High Frequency Reciprocating Wear (HFRR) testing.

In another embodiment, the fatty acid sorbitan ester compositions of the present invention exhibit excellent oxidative and/or thermal stability. In one embodiment, the thermal stability of the fatty acid sorbitan ester composition is measured by the decomposition onset temperature of the composition. In preferred embodiments, the decomposition onset temperature is greater than about 150° C., e.g., greater than 180° C., greater than about 200° C., greater than about 230° C. or greater than about 250° C., as measured by TGA. In terms of ranges, the decomposition onset temperature optionally ranges from about 150° C. to about 500° C., e.g., from about 235° C. to about 300° C. or from about 250° C. to about 275° C. Also, the fatty acid sorbitan ester compositions preferably have a thermal oxidative stability of greater than 10 minutes, e.g., greater than 12 minutes, greater than 15 minutes, greater than 18 minutes or greater than 25 minutes, as measured by Pressure Differential Scanning calorimetry (PDSC) Oxidation Induction Time (OIT) testing run at 130° C. with $O_2$ (which accelerates normal oxidation times, e.g., from hours to minutes).

In one embodiment, the fatty acid sorbitan ester composition comprises a mixture of several fatty acid sorbitan esters. In another embodiment, the fatty acid sorbitan ester composition comprises a mixture of the fatty acid sorbitan esters discussed above. Preferably, the fatty acid sorbitan ester composition may be a mixture TSEs and CSEs.

The fatty acid sorbitan esters of the present invention may be represented by the general formula:

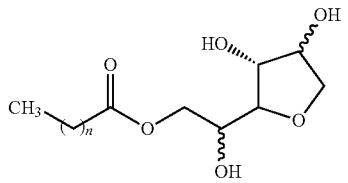

wherein n is a whole number from 6 to 28, e.g., from 8 to 22, from 10 to 20 from 12 to 16 or from 14 to 18, and, preferably, n is 16 and is derived from tallow fatty acid. In another embodiment, the fatty acid sorbitan ester has a fatty acid moiety chain length of greater than 4 carbon atoms, e.g., greater than 6 carbon atoms, greater than 8 carbon atoms or greater than 10 carbon atoms. For example, the tallow fatty acid ester may comprise a lauryl sorbitan ester in which the fatty acid moiety contains about 12 carbon atoms. Typically, the fatty acid sorbitan ester compositions of the invention will include a mixture of various fatty acid sorbitan ester compounds, and the above general formula is merely exemplary of some of the tallow fatty acid esters contained in the composition. The fatty acid carbon chain may be straight chain or branched, and saturated or partially unsaturated, or a mixture thereof.

Additionally or alternatively, the fatty acid sorbitan ester compositions of the invention may include fatty acid sorbitan esters that are substituted, e.g., substituted with one or more of alkyl, aryl, acyl alkoxy and/or phenyl groups. In one embodiment, the fatty acid sorbitan esters are substituted with alkyl groups.

In some embodiments, the fatty acid sorbitan esters are completely saturated. For example, in a preferred embodiment, the fatty acid moiety is a $C_{12}$ laurate. In other embodiments, the fatty acid sorbitan esters are partially saturated. For example, the fatty acid moiety may comprise a $C_{18}$ oleate. In still other embodiments, the fatty acid sorbitan esters are unsaturated or completely unsaturated. Preferably, the saturation may be achieved via hydrogenation. As a result, the fatty acid sorbitan esters may be saturated, e.g., fully saturated, hydrogenated fatty acid sorbitan esters.

Suitable fatty acid sorbitan esters are commercially available as Kemester™ 5632.

Preparation

The fatty acid sorbitan esters of the present invention, in one embodiment, are prepared by reacting a fatty acid, e.g., a tallow fatty acid (TFA), with one or more sorbitols and/or sorbitans. In some embodiments, the fatty acid is reacted with a sorbitol to form a fatty acid sorbitol. In one embodiment, the sorbitol moiety of such a fatty acid sorbitol is cyclized to form the fatty acid sorbitan. In other embodiments, the sorbitol is cyclized to form a sorbitan, which may then be reacted with the fatty acid to form the fatty acid sorbitan. In still other embodiments, a mixture of sorbitols and sorbitans are reacted with the fatty acid. The fatty acid sorbitols that result from this reaction may then be cyclized to form the fatty acid sorbitans.

The fatty acid used to form the fatty acid sorbitan esters of the invention preferably has the structure:

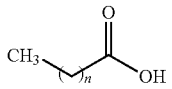

wherein n is a whole number from 6 to 28, e.g., from 8 to 22, from 10 to 20 from 12 to 16 or from 14 to 18, and, preferably, n is 16. The carbon chain in the fatty acid (as well as the resulting fatty acid sorbitan ester composition of the invention) may be fully saturated, partially unsaturated or a combination thereof. Unsaturation in the fatty acid is usually determined by iodine number, which in preferred embodiments, can vary 100 to less than 1, e.g., from 90 to less than 1 or from 65 to less than 1, depending on the amount of unsaturated fatty acid and whether the fatty acid is further saturated by hydrogenation. In one embodiment, the fatty acid (as well as the resulting fatty acid sorbitan ester composition of the invention) includes partially unsaturated tallow fatty acids having the general formula:

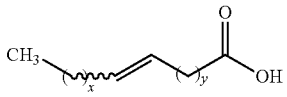

wherein x and y are whole numbers, and (x+y) equals the sum of from 4 to 26, e.g., from 6 to 20, from 8 to 18 or from 12 to 16, and, preferably, (x+y) is 14. In one embodiment, the fatty acid sorbitan ester is multiply unsaturated. In still another embodiment, the level of multiple unsaturation is less than 10%, e.g., less than 7%, less than 5% or less than 3%. For example, where x=7 and y=7, the resulting partially unsaturated fatty acid has the structure:

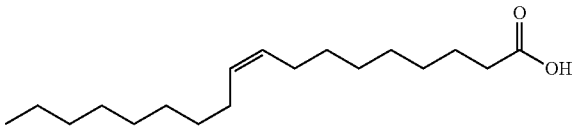

It is noted that this formula shows the fatty acid in cis-form. In other embodiments, the fatty acid is in the trans-form. Thus, the fatty acid may be the cis form, the trans form, or a mixture thereof. In certain embodiments, the cis-form is "kinked" and may soften more than the trans-form. This phenomenon may be useful in particular applications. In a preferred embodiment, the fatty acid (and the resulting fatty acid sorbitan ester composition of the invention) comprises a mixture of fully saturated fatty acids and partially unsaturated fatty acids. In other embodiments, such fatty acids may be substituted at any one or more of the carbons. The substituents may include, for example, one or more alkyl, aryl, acyl, alkoxy and/or branched alkyl(iso-stearic) groups.

In various optional embodiments, the fatty acid is selected from one or more of stearic acid, oleic acid, myristic acid and/or a palmitic acid. Of course, these fatty acides are merely exemplary and other fatty acids may be employed to form the fatty acid sorbitan ester compositions of the invention.

In preferred embodiments, the sorbitans are prepared by the cyclization of sorbitols. Sorbitols may be represented by the following general formula:

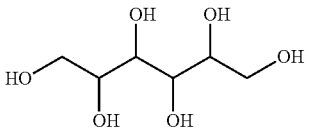

and may comprise a mixture of stereoisomers thereof. The dominant sorbitol stereoisomer that preferably is employed to form the fatty acid sorbitan ester compositions of the present invention is represented by the following formula, and preferably is present in the reactant sorbitol in an amount greater than 60 wt. %, greater than 80 wt. % or greater than 90 wt. %, based on the total weight of the sorbitol reactant employed:

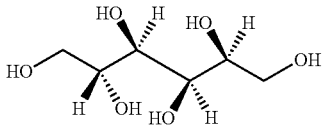

D-sorbitol

In preferred embodiments, sorbitol, e.g., D-sorbitol or D-glucitol, may be cyclized, e.g. dehydrized, to form D-sorbitans, which may be utilized in the reaction with fatty acids (see above) to form the fatty acid sorbitan esters of the invention. The cyclization reaction is preferably achieved in the presence of a phosphoric acid catalyst at elevated temperatures, e.g., greater than 150° C., greater than 200° C. or greater than 250° C., and may form the cyclized D-sorbitan isomers shown below.

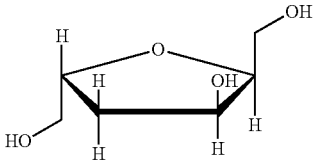

5,2-linkage and/or

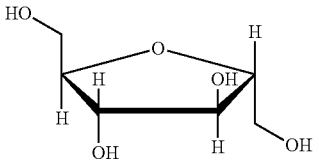

2,5-linkage and/or

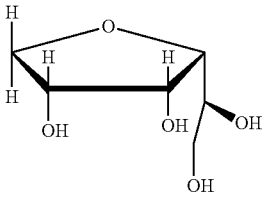

3,6-linkage and/or

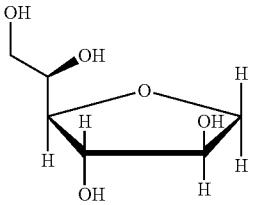

1,4-linkage

The D-sorbitans having the 3, 6 linkage and/or the 1,4-linkage may further dehydrize to form the corresponding bicyclic isosorbide.

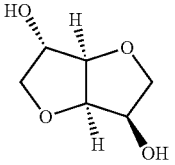

Isosorbide

In preferred embodiments, the fatty acid is reacted with the sorbitan, e.g. 1,4-sorbitan, to form a mixture of the following mono-, di- and tri-esters. As will be appreciated by those skilled in the art, many various isomers of the mono-, di- and tri-esters may be formed and these chemical formulae are merely exemplary of the some of the mono-, di- and tri-esters that may be formed.

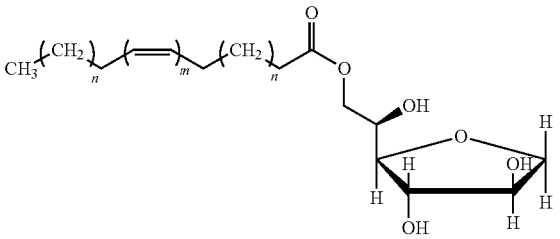

Mono-ester

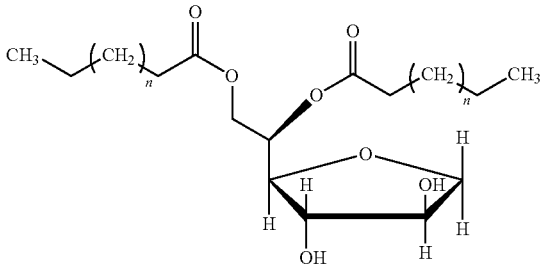

Di-ester

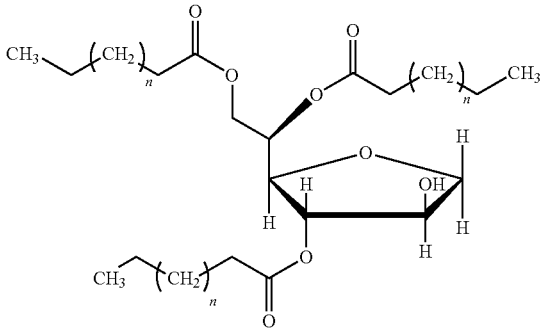

Tri-ester

In preferred embodiments, a tallow fatty acid is reacted with the sorbitan, e.g., a 1,4-sorbitan, to provide a mixture of mono-, di- and tri-esters, e.g., tallow sorbitan mono-esters, tallow sorbitan di-esters, tallow sorbitan tri-esters. Additionally, isosorbide may be added to the reaction (i.e., generated in a separate reaction) or generated in-situ from the sorbitans to form one or more isosorbide esters, as shown below.

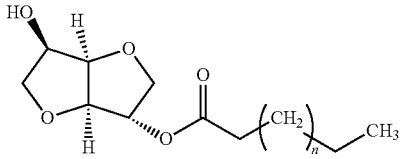

Isosorbide ester

Thus, in another embodiment, a tallow fatty acid is esterified by one or more isosorbides to yield one or more tallow isosorbide esters. In a preferred embodiment, a mixture of saturated and unsaturated tallow fatty acids, and saturated and unsaturated coconut fatty acids are esterified by one or more isosorbides to form a mixture of tallow isosorbide esters and coconut isosorbide esters.

The molar ratios of the various mono-esters, di-esters, tri-esters and/or isosorbide esters to one another in the fatty acid sorbitan ester may be manipulated to control the viscosity of the fatty acid sorbitan ester composition. Optionally, the molar ratio of mono-esters to di-esters, of mono-esters to tri-esters, of mono-esters to the combination of both di-esters and tri-esters, or of mono-esters to isosorbide esters in the fatty acid sorbitan ester compositions of the invention may range from 1:10 to 10:1, e.g., from 1:5 to 5:1, or about 1:1. Most preferably, the molar ratio of mono-esters to di-esters, or mono-esters to tri-esters, or mono-esters to the combination of both di-esters and tri-esters is at least 1:10, e.g., at least 1:5, at least 1:2 or at least 1:1. The distribution of the ratio of the mono-, di-, tri- and isosorbide esters that are formed may be used to manipulate the chemical and physical properties of the final product, and, accordingly, the performance of the final product. The distribution may, for example, be controlled by the stoichiometry of the reactants, the type of catalyst employed, e.g., acid and/or base, and other reaction conditions. Referring to the reactions discussed above, in a preferred embodiment, tallow fatty acids, e.g., $C_{14}$-$C_{18}$, m is 0, (1+n) is 13. In another preferred embodiment 1 is 6, m is 1 and n is 5. In another embodiment, excess fatty acid is utilized to favor formation of the di- and tri-esters. The manipulation of the reaction parameters may be utilized to affect physical/tribological properties, sorbitol dehydration, degree of esterification and degree of unsaturation.

In a preferred embodiment, the fatty acid sorbitan ester compositions of the present invention are formulated to be solid or semi-solid, e.g., solid or semi-solid tablets, which are released, preferably dissolved, over time in the respective lubricant. Thus, another embodiment the invention is directed to a lubricant composition comprising a lubricant base stock and a fatty acid sorbitan ester composition of the invention. In still another embodiment, the fatty acid sorbitan ester is directed through a flow retarding tight cellulose barrier (utilizing sugar functional group-cellulose sugar molecular attraction). The fatty acid sorbitan ester may be either or both (i) in solid or semi-solid form, and/or (i) dispersed or dissolved in the base stock (but derived from the fatty acid sorbitan ester composition in solid or semi-solid form).

Preferably, the fatty acid is directly esterified by one or more sorbitans. In a preferred embodiment, a fatty acid halide is esterified by one or more sorbitans to yield the fatty acid sorbitan esters of the present invention. For example, a tallow acid halide may be reacted with one or more sorbitans to form one or more TSEs.

Alternatively, a methyl tallowate may be indirectly trans-esterified by the sorbitol. In a preferred embodiment, the sorbitol is dehydrated to form a cyclic sugar. The dehydrated sorbitol may then be reacted with the fatty acid to form the fatty acid sorbitan ester. One preferred embodiment utilizes a tallow fatty acid containing 3% Myristic (Tetradecanoic: $C_{14}$), 0.4% (cis-9-Tetradecenoic: $C_{14:1}$), 26.3% Palmitic (Hexadecanoic: $C_{16}$), 2.6% (cis-9-Hexadecenoic), 0.4% (Heptacecanoic: $C_{17}$), 0.4% (Heptadecenoic $C_{17:1}$), 22.4% Stearic (Octadecanoic: $C_{18}$), 43.1% Oleic: (cis-9-Octadecenoic), and 1.4% Linoleic (cis-9, cis-12-Octadecadienoic: $C_{18:2}$).

In addition to the fatty acid sorbitan ester compositions, in other embodiments, the invention is directed to methods of producing fatty acid sorbitan esters comprising esterifying one or more fatty acids, e.g., tallow fatty acids, with one or more sorbitols or sorbitans to form one or more fatty acid sorbitan esters as well as to methods of producing fatty acid sorbitan esters comprising trans-esterifying one or more fatty acids, e.g., tallow fatty acids, with one or more sorbitols or sorbitans to form the one or more fatty acid sorbitan esters. The reaction parameters discussed above are also applicable to the inventive methods for producing fatty acid sorbitan esters.

The reaction conditions employed to form the fatty acid sorbitan ester compositions of the invention may vary widely. Preferably, the fatty acid is reacted with the sorbitan at a temperature ranging from about 25° C. to about 300° C., e.g., from about 50° C. to about 300° C., from about 100° C. to about 280, from about 150° C. to about 280° C., from about 180° C. to about 250° C. or about 200° C. to about 250° C. In some embodiments, the reaction takes place at pressures ranging from about 1 torr to about 400 torr, e.g., from about 2 torr to about 350 torr, from about 10 torr to about 300 torr or from about 10 torr to about 200 torr. In one embodiment, the pressure at which the reaction is run is increased by utilizing nitrogen $N_2$ sparging. In other embodiments the molar ratio of sorbitol to fatty acid ranges from about 10:1 to about 1:10, e.g., from about 6:1 to about 1:6, from about 3:1 to about 1:3 or from about 1:1 to about 1:2. Preferably, the molar ratio is about 1:1. In other embodiments, the molar ratio of sorbitol to fatty acid may be selected depending upon the desired level of di-ester and/or tri-ester.

The reaction may take place in any suitable reactor known in the art. Preferably, the reactor is a stainless steel reactor or a glass-lined reactor. In one embodiment, the reaction may be run as a batch process. In another embodiment, the reaction may be run in a continuous manner. In still other embodiments, suitable catalysts may be utilized to promore the reaction. In one embodiment, residual catalyst is neutralized before obtaining the final product. In other embodiments, the final product is washed, e.g., washed with water, to remove the catalyst salts from the reaction mixture. In other embodiments, the water wash serves to separate and, optionally remove, any unreacted sorbitol. Such a procedure may be followed by atmospheric and/or vacuum stripping to remove residual water. Of course, this list is not limiting and other separation methods may be employed.

Additives

In addition to being effective friction modifiers, the fatty acid sorbitan esters of the present invention are well suited to combination with other additional additives, which may be separately added to the lubricant or contained within the solid or semi-solid fatty acid sorbitan ester compositions of the invention, i.e., as a solid solution or mixture. In the latter embodiment, the fatty acid sorbitan ester compositions beneficially may function to gradually release the additive as the fatty acid sorbitan ester compound is released into the lubricant. The mixture of the additives may be achieved in any suitable manner known in the art. In a preferred embodiment, the fatty acid sorbitan esters and the additional additives are mechanically mixed together and pressed into a single solid mass. In another preferred embodiment, the individual fatty acid sorbitan esters and additional additives are melted, e.g., heated to above the respective melting points, and blended in the molten state. The molten material may then be cooled to form the solid fatty acid sorbitan ester composition.

Thus, in some embodiments, the invention is to a friction modifier composition (fatty acid sorbitan ester composition) comprising one or more fatty acid sorbitan esters and one or more additives. In some embodiments of the present invention, the friction modifier composition, i.e., fatty acid sorbitan ester composition, further comprises one or more of the following: viscosity modifiers, additional friction modifiers, detergents, cloud point depressants, pour point depressants, demulsifiers, flow improvers, antistatic agents, dispersants, antioxidants, antifoams, corrosion inhibitors, rust inhibitors, extreme pressure/antiwear agents, seal swell agents, lubricity acids, antimisting agents and mixtures thereof.

In one embodiment of the invention, the fatty acid sorbitan esters and the (at least one) additional additives are combinable in any amount or in any ratio. In one embodiment, the composition comprises the fatty acid sorbitan ester in a major amount and other additive(s) in a minor amount. In other embodiments, the fatty acid sorbitan esters are present in an amount ranging from 5 weight percent to 95 weight percent, e.g., from 10 weight percent to 90 weight percent, from 20 weight percent to 80 weight percent, from 25 weight percent to 75 weight percent or from 25 weight percent to 60 weight percent, based on the total weight of the fatty acid sorbitan ester composition. In other embodiments, the additional additives are present in an amount ranging from 5 weight percent to 95 weight percent, e.g., from 10 weight percent to 90 weight percent, from 20 weight percent to 80 weight percent, from 25 weight percent to 75 weight percent or from 25 weight percent to 60 weight percent, based on the total weight of the fatty acid sorbitan ester composition. In terms of ratios, the ratio of fatty acid sorbitan ester to additional additive(s) may range from 10:1 to 1:10, e.g., from 2:8 to 8:2, from 3:6 to 6:3 or from 1:2 to 2:1.

The fatty acid sorbitan esters of the present invention perform particularly well with antioxidants. Accordingly, preferred embodiments include combinations of fatty acid sorbitan esters and antioxidants, e.g., aminic antioxidants and phenolic antioxidants. Preferred aminic antioxidants are octylated diphenylamine and liquid aminics: phenyl-α-napthylamine; nonylated diphenylamine; styrenated diphenylamine; octylated butylated diphenylamine; other alkylated diphenylamines; N,N'-di-sec-butyl-p-phenylenediamine; N-phenyl-N'alkyl-p-phenylenediamine; N,N'-di-isopropyl-p-phenylenediamine and mixtures thereof. Preferably, these aminic antioxidants are solid. Preferred phenolic antioxidants are solid phenolics, BHT, Pyrogallol, Tert-butyl-hydroquinone, as well as liquid phenolics: 2,6-di-tertbutylphenol, 2,4-di-methyl-6-tertbutylphenol, 2-methyl-6-tertbutylphenol, 2-tertbutyl-4-methylphenol; 2,6-dimethyl-4-tertbutylphenol; 2,6-bis(α-methylbenzyl)-4-methylphenol and mixtures thereof. In addition, preferred embodiments may utilize, as aminic antioxidants, Naugalube 438L, Naugalube™ 403, Naugalube™ 420, Naugalube™ 410, and mixtures thereof. These are commercial products manufactured by Chemtura Corporation. Additionally or alternatively, preferred embodiments may utilize, as phenolic antioxidants, Naugalube FAO™ 30, Naugalube FAO™ 31, Naugalube FAO™ 32. Further preferred embodiments utilize blends of antioxidants including, but not limited to, Naugalube™ 403, Naugalube™ 420, Naugalube™ 431, Naugalube™ 438, Naugalube™ 438L, Naugalube™ 531, Naugalube™ 635, Naugalube™ 640, Naugalube™ 680 Naugalube™ ANS, Naugalube™ APAN, Naugalube™ PANA, Naugalube FAO™ 80, Naugalube FAO™ 100 and mixtures thereof. In addition, preferred embodiments utilize Moldpro 873 laurylamide of diethanol amine, which is a commercial product formerly manufactured by Chemtura Corporation, and is also manufactured by other manufacturers, e.g., Stepan Corp.

In some embodiments, the inventive fatty acid sorbitan ester compositions comprise tartrates and/or citrates. These tartrates and/or citrates may be substituted by alkyl, aryl, acyl alkoxy and/or, alkoxyl groups. A particularly preferable embodiment utilizes an alkyl tartrate in combination with the fatty acid sorbitan ester. Preferably, the additional additives include $C_{12}$-$C_{14}$ acetal of tartrate, diethyl tartrate, diisopropyl tartrate, and mixtures thereof. In preferred embodiments, the alkyl tartrate is HXL 7121 or HXL 7353, which are laboratory experimental products produced by Chemtura Corporation. In another preferred embodiment, the HXL 7121 or HXL 7353 is combined with the fatty acid sorbitan ester at a ratio of about 1:10 to about 10:1, e.g., from about 2:8 to about 8:2, about 0.25:1 to about 2:1 or about 0.5:1 to about 0.75:1.

In a preferred embodiment, the fatty acid sorbitan ester composition is blended with a viscosity modifier to adjust viscosity. In other embodiments, viscosity modifiers such as alkanolamides, poly-α-olefins, polyisobutylenes and polyethers are combined with the fatty acid sorbitan ester. In other preferred embodiments, a high-molecular weight viscosity modifier, e.g., having a $M_w$ greater than 5,000, greater than 10,000 or greater than 20,000, is utilized to adjust the viscosity of the fatty acid sorbitan ester composition. In a preferred embodiment, the fatty acid sorbitan ester is combined with a lauryl diethanolamide at a molar ratio of from 1:10 to 10:1, e.g., from 2:8 to 8:2 or about 1:1.

Of course, additives other than those listed above may be utilized in combination with the fatty acid sorbitan esters and the additives mentioned above. Examples of other additives follow.

Ashless dispersants may be utilized, including Mannich dispersants, polymeric dispersants, carboxylic dispersants, amine dispersants, and combinations and mixtures thereof, all of which are substantially free of forming ash or are completely free of forming ash. In one embodiment, the preferred dispersant is polyisobutenyl succinimide dispersant.

Suitable ashless dispersants include, but are not limited to, ashless dispersants such as a polyisobutenyl succinimide. Polyisobutenyl succinimide ashless dispersants are commercially available products which are typically made by reacting together polyisobutylene having a number average molecular weight ($M_n$) of about 300 to 10,000 with maleic anhydride to form polyisobutenyl succinic anhydride (PIBSA) and then reacting the product so obtained with a polyamine typically containing 1 to 10 ethylene amino groups per molecule. The dispersant so obtained is typically formed from a mixture of different compounds and can be characterized by a variety of different variables including the degree of amine substitution (i.e., the ratio of the equivalents of amino groups to carbonylic groups, or the N:CO ratio), the maleic anhydride conversion level (i.e., the molar ratio of maleic anhydride to PIB, as defined in U.S. Pat. No. 4,234,435, which is hereby incorporated by reference in its entirety), the $M_n$ of the PIB group, and the mode of preparation (thermal assisted succination vs. $Cl_2$-assisted succination). Analogous compounds made with other polyamines (e.g. polypropenyl) may also be used. Ashless dispersants of this type are described, for example, in U.S. Pat. No. 4,234,435, which is hereby incorporated by reference in its entirety.

The Mannich dispersants may be the reaction products of alkyl phenols in which the alkyl group contains at least about 30 carbon atoms with aldehydes (especially formaldehyde) and amines (especially polyalkylene polyamines).

Another class of suitable ashless dispersants is nitrogen containing carboxylic dispersants. Examples of these "carboxylic dispersants" are described in U.S. Pat. No. 3,219,666, which is hereby incorporated by reference in its entirety.

Suitable amine dispersants, include, but are not limited to, reaction products of relatively high molecular weight aliphatic halides and amines, preferably polyalkylene polyamines. Examples thereof are described, in U.S. Pat. No. 3,565,804 which is hereby incorporated by reference in its entirety.

Suitable polymeric dispersants include, but are not limited to, interpolymers of oil-solubilizing monomers such as decyl methacrylate, vinyl decyl ether and high molecular weight olefins with monomers containing polar substituents, e.g., amino alkyl acrylates or acrylamides and poly-(oxyethylene)-substituted acrylates. Examples of polymer dispersants thereof are disclosed in the following U.S. Pat. Nos. 3,329,658 and 3,702,300, each of which are hereby incorporated by reference in its entirety.

Dispersants may also be post-treated by reaction with any of a variety of agents. Among these are urea, thiourea, dimercaptothiazoles, carbon disulfide, aldehydes, ketones, carboxylic acids, hydrocarbon-substituted succinic anhydrides, nitriles, expoxides, boron compounds, and phosphorus compounds.

Specific antioxidants other than those discussed above include, but are not limited to, alkyl-substituted phenols such as 2,6-di-tertiary butyl-4-methyl phenol, phenate sulfides, phosphosulfurized terpenes, sulfurized esters, aromatic amines, diphenyl amines, alkylated diphenyl amines and hindered phenols, bis-nonylated diphenylamine, nonyl diphenylamine, octyl diphenylamine, bis-octylated diphenylamine, bis-decylated diphenylamine, decyl diphenylamine and mixtures thereof.

Suitable sterically hindered phenols include, but are not limited to, 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, 4-pentyl-2-6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, 4-tridecyl-2,6-di-tert-butylphenol, 4-tetradecyl-2,6-di-tert-butylphenol, methylene-bridged sterically hindered phenols include but are not limited to 4,4-methylenebis(6-tert-butyl-o-cresol), 4,4-methylenebis(2-tert-amyl-o-cresol), 2,2-methylenebis(4-methyl-6-tert-butylphenol), 4,4-methylene-bis(2,6-di-tertbutylphenol) and mixtures thereof Suitable extreme pressure (EP)/anti-wear agents include, but are not limited to, a sulfur or chlorosulphur EP agent, a chlorinated hydrocarbon EP agent, or a phosphorus EP agent, or mixtures thereof. Examples of such EP agents are amine salts of phosphorus acid acid, chlorinated wax, organic sulfides and polysulfides, such as benzyldisulfide, bis-(chlorobenzyl)disulfide, dibutyl tetrasulfide, sulfurized sperm oil, sulfurized methyl ester of oleic acid sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used and mixtures thereof.

In one embodiment, the fatty acid sorbitan ester composition includes an antiwear agent/EP agent comprising an amine salt of a phosphorus ester acid. The amine salt of a phosphorus ester acid includes phosphoric acid esters and salts thereof, dialkyldithiophosphoric acid esters and salts thereof, phosphites; and phosphorus-containing carboxylic esters, ethers, and amides; and mixtures thereof.

Suitable amines other than those mentioned above include, but are not limited to, primary amines, secondary amines, tertiary amines, and mixtures thereof. These amines include those with at least one hydrocarbyl group, or, in certain embodiments, two or three hydrocarbyl groups. The hydrocarbyl groups may contain about 2 to about 30 carbon atoms, or in other embodiments about 8 to about 26 or about 10 to about 20 or about 13 to about 19 carbon atoms.

Suitable primary amines may include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleylamine. Other useful fatty amines include commercially available fatty amines such as "ArmeenOR" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

In some embodiments, the amine may also be a tertiary-aliphatic primary amine. The aliphatic group in this case may be an alkyl group containing about 2 to about 30, or about 6 to about 26, or about 8 to about 24 carbon atoms. Tertiary alkyl amines include monoamines such as tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

Mixtures of amines may also be used in the invention. In one embodiment a useful mixture of amines is "Primene™ 81R" and "Primene™ JMT." Primene™ 81R and Primene™ JMT (produced and sold by Rohm & Haas) are mixtures of $C_{11}$ to $C_{14}$ tertiary alkyl primary amines and $C_{18}$ to $C_{22}$ tertiary alkyl primary amines respectively.

In one embodiment, the hydrocarbyl amine salt of an alkylphosphoric acid ester is the reaction product of a $C_{14}$ to $C_{18}$ alkylated phosphoric acid with Primene 81™ (produced and sold by Rohm & Haas) which is a mixture of $C_{11}$ to $C_{14}$ tertiary alkyl primary amines.

Examples of suitable hydrocarbyl amine salts of dialkyldithiophosphoric acid esters include the reaction product(s) of hexyl, heptyl or octyl or nonyl, 4-methyl-2-pentyl or 2-ethylhexyl, isopropyl dithiophosphoric acids with ethylene diamine, morpholine, or Primene 81R™, and mixtures thereof.

In one embodiment, the dithiophosphoric acid is reacted with an epoxide or a glycol. This reaction product is further reacted with a phosphorus acid, anhydride, or lower ester. The epoxide may include an aliphatic epoxide or a styrene oxide. Examples of suitable epoxides include ethylene oxide, propylene oxide, butene oxide, octene oxide, dodecene oxide, styrene oxide and the like. In one embodiment, the epoxide is propylene oxide. Suitable glycols may be aliphatic glycols having from 1 to about 12, or from about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465, each of which are incorporated herein by reference in its entirety. The resulting acids may then be salted with amines. An example of suitable dithiophosphoric acid is prepared by adding phosphorus pentoxide (about 64 grams) at about 58° C. over a period of about 45 minutes to about 514 grams of hydroxypropyl O,O-di(4-methyl-2-pentyl)phosphorodithioate (prepared by reacting di(4-methyl-2-pentyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulfur, and an acid number of 87 (bromophenol blue).

Suitable antifoams include, but are not limited to, organic silicones such as poly dimethyl siloxane, poly ethyl siloxane, polydiethyl siloxane, polyacrylates and polymethacrylates, trimethyl-triflouro-propylmethyl siloxane and the like.

Suitable viscosity modifiers other than those discussed above may provide both viscosity improving properties and dispersant properties. Examples of dispersant-viscosity modifiers include, but are not limited to, vinyl pyridine, N-vinyl pyrrolidone and N,N'-dimethylaminoethyl methacrylate are examples of nitrogen-containing monomers and the like. Polyacrylates obtained from the polymerization or copolymerization of one or more alkyl acrylates also are useful as viscosity modifiers.

In some embodiments, functionalized polymers are used as viscosity modifiers. Among the common classes of such polymers are olefin copolymers and acrylate or methacrylate copolymers. Functionalized olefin copolymers can be, for instance, interpolymers of ethylene and propylene which are grafted with an active monomer such as maleic anhydride and then derivatized with an alcohol or an amine. Other such copolymers are copolymers of ethylene and propylene which are reacted or grafted with nitrogen compounds. Derivatives of polyacrylate esters are well known as dispersant viscosity index modifiers additives. Dispersant acrylate or polymethacrylate viscosity modifiers such as Acryloid™ 985 or Viscoplex™ 6-054, from RohMax, are particularly suitable. Solid, oil-soluble polymers such as the PIB, methacrylate, polyalkystyrene, ethylene/propylene and ethylene/propylene/1,4-hexadiene polymers and maleic anhydride-styrene interpolymer and derivatives thereof, can also be used as viscosity index improvers.

In one embodiment, the friction modifiers other than those mentioned above may include organo-molybdenum compounds, including molybdenum dithiocarbamates, and fatty acid based materials, including those based on oleic acid, including glycerol mono-oleate, those based on stearic acid, and the like.

In one embodiment, the friction modifier is a phosphate ester or salt including a monohydrocarbyl, dihydrocarbyl or a trihydrocarbyl phosphate, wherein each hydrocarbyl group is saturated. In several embodiments, each hydrocarbyl group contains from about 8 to about 30, or from about 12 up to about 28, or from about 14 up to about 24, or from about 14 up to about 18 carbons atoms. In another embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

In one embodiment, the phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435, which is hereby incorporated by reference in its entirety.

Metal salts of the phosphorus acid esters that are prepared by the reaction of a metal base with the acidic phosphorus ester may be utilized in combination with the fatty acid sorbitan esters. The metal base may be any metal compound capable of forming a metal salt. Examples of metal bases include metal oxides, hydroxides, carbonates, borates, or the like. Suitable metals include alkali metals, alkaline earth metals and transition metals. In one embodiment, the metal is a Group IIA metal, such as calcium or magnesium, Group IIB metal, such as zinc, or a Group VIIB metal, such as manganese. Examples of metal compounds which may be reacted with the phosphorus acid include zinc hydroxide, zinc oxide, copper hydroxide or copper oxide.

In one embodiment, additional friction modifiers such as phosphites may be utilized, such phosphites include, but are not limited to, monohydrocarbyl, dihydrocarbyl or trihydrocarbyl phosphites, wherein each hydrocarbyl group may be saturated. In other embodiments, each hydrocarbyl group independently contains from about 8 to about 30, or from about 12 up to about 28, or from about 14 up to about 24, or from about 14 up to about 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

In one embodiment, the additional friction modifier may be a fatty imidazoline comprising fatty substituents containing from 8 to about 30, or from about 12 to about 24 carbon atoms. The substituent may be saturated or unsaturated, preferably saturated. In one aspect, the fatty imidazoline may be prepared by reacting a fatty carboxylic acid with a polyalkylenepolyamine, such as those discussed above. A suitable fatty imidazoline includes those described in U.S. Pat. No. 6,482,777, which is hereby incorporated by reference in its entirety.

Suitable anti-misting agents include, but are not limited to, very high (≥100,000 $M_n$) polyolefins such as 1.5 Mn polyisobutylene (for example the material of the trades name Vistanex™), or polymers containing 2-(N-acrylamido), 2-methyl propane sulfonic acid (also known as AMPS™), or derivatives thereof.

Suitable corrosion inhibitors include, but are not limited to, alkylated succinic acids and anhydrides derivatives thereof, organo phosphonates and the like. The rust inhibitors may be used alone or in combination.

Suitable ashless metal deactivators include, but are not limited to, derivatives of benzotriazoles such as tolyltriazole, N,N-bis(heptyl)-ar-methyl-1H-benzotriazole-1-methanamine, N,N-bis(nonyl)-ar-methyl-1H-Benzotriazole-1-methanamine, N,N-bis(decyl)ar-methyl-1H-Benzotriazole-1-methanamine, N,N-(undecyl)ar-methyl-1H-benzotriazole-1-methanamine, N,N-bis(dodecyl)ar-methyl-1H-Benzotriazole-1-methanamine N,N-bis(2-ethylhexyl)-ar-methyl-1H-Benzotriazole-1-methanamine and mixtures thereof. In one embodiment the metal deactivator is N,N-bis(1-ethylhexyl)ar-methyl-1H-benzotriazole-1-methanamine; 1,2,4-triaz-oles, benzimidazoles, 2-alkyldithiobenzimidazoles; 2-alkyldithiobenzothiazoles; 2-N,N-dialkyldithio-carbamoyl)benzothiazoles; 2,5-bis(alkyl-dithio)-1,3,4-thiadiazoles such as 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-octadecyldithio)-1,3,4-thiadiazole, 2,5-bis(tert-nonadecyldithio)-1,3,4-thiadiazole, 2,5-bis(tert-eicosyldithio)-1,3,4-thiadiazole and mixtures thereof; 2,5-bis(N,N-dialkyldithiocarbamoyl)-1,3,4-thiadiazoles; and 2-alkydithio-5-mercapto thiadiazoles.

Suitable demulsifiers include, but are not limited to, polyethylene and polypropylene oxide copolymers and the like. Suitable lubricity aids include, but are not limited to, glycerol mono oleate, sorbitan mono oleate and the like. Suitable flow improvers include, but are not limited to, ethylene vinyl acetate copolymers and the like. Suitable cloud point depressants include, but are not limited to, alkylphenols and derivatives thereof, ethylene vinyl acetate copolymers and the like. Suitable pour point depressants include, but are not limited to, alkylphenols and derivatives thereof, ethylene vinyl acetate copolymers and the like. Suitable seal swell agents include, but are not limited to, organo sulfur compounds such as thiophene, 3-(decyloxy)tetrahydro-1,1-dioxide, phthalates and the like. These additional additives may be used alone or in combination.

In preferred embodiments of the present invention, the fatty acid sorbitan ester compositions contain no ash, e.g., the fatty acid sorbitan ester compositions are ash-free, or contain minimal ash. In other preferred embodiments, the fatty acid sorbitan ester compositions contain minimal amounts of heavy metals or are free of heavy metals. Furthermore, in other embodiments, the fatty acid sorbitan ester compositions contain no or minimal amounts of zinc dialkyl dithio phosphate (ZDDP), e.g., less than 10 weight percent, less than 5 weight percent, less than 3 weight percent or less than 1 weight percent, based on the total weight of the fatty acid sorbitan ester composition.

Lubricant Compositions

In addition to the fatty acid sorbitan ester compositions, the invention also relates to a lubricant composition comprising the fatty acid sorbitan ester compositions discussed above and a base lubricant, e.g., a base stock. Typically, as base stocks are utilized to lubricate the respective systems and/or devices, the lubricating properties of the base stock deteriorate over time. When the fatty acid sorbitan ester compositions of the present invention are gradually blended with the base stocks, the lubricating properties that are lost over time are replenished by the fatty acid sorbitan esters. Thus, the newly introduced fatty acid sorbitan esters provide supplemental lubricating properties that balance the properties lost by the lubricant over time. In other words, the controllably released fatty acid sorbitan esters of the present invention preferably work to increase, maintain or slow the reduction of lubricating properties in a base stock throughout the lifetime of the lubricant. In one embodiment, the fatty acid sorbitan ester composition is released, e.g., controllably released, into the base stock. In a preferred embodiment, the fatty acid sorbitan ester is controllably released into the base stock at the rates discussed above.

In preferred embodiments, free fatty acid sorbitan ester is present in the lubricant composition in an amount ranging from about 1 part per million to about 50,000 parts per million, e.g., from about 1 part per million to about 5,000 parts per million, from about 1 part per million to about 1000 parts per million or from about 50 parts per million to about 750 parts per million, based on the total parts by weight of the lubricant composition. In this context, "free" fatty acid sorbitan ester refers to fatty acid sorbitan ester that is solubilized or dispersed in the base stock exclusive of solid or semi-solid fatty acid sorbitan ester composition from which the free fatty acid sorbitan ester may be derived.

In other preferred embodiments, in addition to the free fatty acid sorbitan esters, the inventive lubricant compositions may further comprise additional additives, as discussed above. In preferred embodiments, the suitable additional additives are present in the lubricant in an amount ranging from about 1 part per million to about 50,000 parts per million, e.g., from about 1 part per million to about 5,000 parts per million, from about 1 part per million to about 1000 parts per million or from about 50 parts per million to about 750 parts per million, based on the total parts of the lubricant composition. Of course, the desired concentration of the one or more additives will vary widely depending on the additive in question and its purpose. In preferred embodiments, the additional additives of the lubricant composition comprises one or more alkyl tartrates, e.g., one or more of HXL 7121 and/or HXL 7353. The HXL 7121 and/or HXL 7353 may be combined with the fatty acid sorbitan ester at a ratio ranging from 10:1 to 1:10, e.g., from 2:8 to 8:2, from 3:6 to 6:3 or from 1:2 to 2:1. Preferably, the ratio of HXL 7121 and/or HXL 7353 to fatty acid sorbitan ester is about 1:1. The one or more alkyl tartrates may be added separately to the base stock or may be incorporated in a solid or semi-solid fatty acid sorbitan ester composition such that the one or more alkyl tartrates are gradually released into the base stock.

In other embodiments, the fatty acid sorbitan ester compositions of the present invention may be utilized in fuel compositions. In such embodiments, all of the parameters that apply to lubricant compositions/lubricant combinations apply equally to the use of the fatty acid sorbitan esters in fuel compositions and in methods and devices for improving the friction reducing ability of fuels or fuel compositions. In preferred embodiments, the inventive fatty acid sorbitan ester compositions can be utilized in fuel filters much the same way as has been described in relation to lubricant, e.g., oil filters. In preferred embodiments, the fatty acid sorbitan esters can be utilized with fuels such as, hydrocarbon fuels, gasoline, diesel fuels, and biodiesel.

Preferably, the fatty acid sorbitan esters and/or additives are released into the base stock at a release rate not greater than about 0.5 grams per minute, e.g., not greater than about 0.15 grams per minute, not greater than about 0.10 gram per minute, not greater than about 0.075 grams per minute, not greater than about 0.05 grams per minute, not greater than about 0.03 grams per minute, not greater than about 0.025, not greater than about 0.01 grams per minute or not greater than 0.0025 grams per minute. In terms of ranges, the release rate optionally ranges from about 0.0001 to about 0.5 grams per minute, e.g., from about 0.0025 to about 0.15 grams per minute, from about 0.01 to about 0.15 grams per minute, from about 0.01 to about 0.1 grams per minute, from about 0.01 to about 0.05 grams per minute or from about 0.01 to about 0.025 grams per minute. The release rates may be measured at temperatures of at least 25° C., e.g., at least 50° C., at least 60° C., at least 70° C., at least 80° C., at least 90° C., at least 95° C., at least 105° C., at least 120° C. or at least 150° C.

In preferred embodiments, the fatty acid sorbitan esters and/or the additional additives released into the base stock reduce the coefficient of friction of the overall lubricant composition. In a preferred embodiment, the fatty acid sorbitan esters and/or the additional additives that have been released in to the respective base stock reduce the coefficient of friction of the respective lubricant, as measured via the Cameron Plint testing method discussed above, by at least 50%, e.g., at least 40%, at least 30%, at least 20% or at least 10%, as measured at temperatures greater than or equal to 50° C., e.g., greater than or equal to 70° C., greater than or equal to 90° C. or greater than or equal to 110° C. In other embodiments, the reduced friction performance is indicated by a reduction in average wear scar of greater than 25%, e.g., greater than 35%, greater than 50% or greater than 60%, as measured by Cameron Plint Wear, Falex Four Ball Wear and/or High Frequency Reciprocating Wear (HFRR) testing.

In other preferred embodiments, the fatty acid sorbitan ester compositions reduce the coefficient of friction in the resultant lubricating composition to below. 1.0, e.g., below 0.8, below 0.75, below 0.7, below 0.6, below 0.4 or below 0.1, as compared to the lubricating composition without the fatty acid sorbitan ester composition. These coefficients of friction may be measured at temperatures greater than 100° C., e.g., greater than 120° C., greater than 130° C., greater than 150° C., greater than 175° C. or greater than 200° C.

Base Stocks

In preferred embodiments, the base stock is selected from natural oils, e.g., mineral oils, petroleum oils, vegetable oils, paraffinic oils, naphthenic oils, aromatic oils, synthetic oils, and derivatives and mixtures thereof. The synthetic oils may comprise at least one of an oligomer of an α-olefin, an ester, an oil derived from a Fischer-Tropsch process, and a gas-to-liquid stock. In one preferred embodiment, the base stock is Excell 100HC™ produced by Penzoil. In other preferred embodiments, the base stock may be only one or more of all Group I, II, III base stocks produced by producers such as Conoco Philips, Chevron, Exon, Shell, Conoco-Philips, Petro-Canada ex. VHVI-4 and Purity 1003].

In other embodiments, the base lubricants may include, but are not limited to, other natural oils including animal oils and vegetable oils, e.g., lard oil, castor oil, and hydrorefined, solvent-treated or acid-treated mineral oils of mixed paraffinic-naphthenic types. Oils of lubricating viscosity derived from coal or shale also serve as useful base oils. Other examples of oils and fats derived from animal or vegetable material are rapeseed oil, coriander oil, soya bean oil, cottonseed oil, sunflower oil, castor oil, olive oil, peanut oil, maize oil, almond oil, canola oil, jojoba oil, palm kernel oil, coconut oil, mustard seed oil, jatropha oil, beef tallow, and fish oils. Further examples include oils derived from corn, jute, sesame, shea nut, ground nut, and linseed oil, and may be derived therefrom by methods known in the art. Rapeseed oil, which is a mixture of fatty acids partially esterified with glycerol, is available in large quantities and can be obtained in a simple way by pressing from rapeseed. Recycled oils such as used kitchen oils are also suitable.

Useful base stocks are, for example, alkyl esters of fatty acids, which include commercial mixtures of the ethyl, propyl, butyl and especially methyl esters of fatty acids with 12 to 22 carbon atoms. For example, lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid, or erucic acid are useful and have an iodine number from 50 to 150, especially 90 to 125. Mixtures with particularly advantageous properties are those which contain mainly, i.e., at least 50 wt. %, methyl esters of fatty acids with 16 to 22 carbon atoms and 1, 2, or 3 double bonds. The preferred lower alkyl esters of fatty acids are the methyl esters of oleic acid, linoleic acid, linolenic acid, and erucic acid.

Commercial mixtures of the stated kind are obtained for example by cleavage and esterification of animal and vegetable fats and oils by their transesterification with lower aliphatic alcohols. For production of alkyl esters of fatty acids, it is advantageous to start from fats and oils which contain low levels of saturated acids, less than 20%, and which have an iodine number of less than 130. Blends of the following esters or oils are suitable, e.g., rapeseed, sunflower, coriander, castor, soya bean, peanut, cotton seed, beef tallow, and the like. Alkyl esters of fatty acids based on a new variety of rapeseed oil, the fatty acid component of which comprises more than 80 wt. % unsaturated fatty acids with 18 carbon atoms, are preferred.

Particularly preferred base stocks are oils capable of being utilized as biofuels. Biofuels, i.e., fuels derived from animal or vegetable material, are believed to be less damaging to the environment on combustion and are obtained from a renewable source. It has been reported that on combustion less carbon dioxide is formed by the equivalent quantity of petroleum distillate fuel, e.g., diesel fuel, and very little sulfur dioxide is formed. Certain derivatives of vegetable oil, e.g., those obtained by saponification and re-esterification with a monohydric alkyl alcohol, can be used as a substitute for diesel fuel.

Preferred biofuels are vegetable oil derivatives, of which particularly preferred biofuels are alkyl ester derivatives of rapeseed oil, cottonseed oil, soya bean oil, sunflower oil, olive oil, or palm oil, rapeseed oil methyl ester being especially preferred, either alone or in admixture with other vegetable oil derivatives, e.g., mixtures in any proportion of rapeseed oil methyl ester and palm oil methyl ester.

At present, biofuels are most commonly used in combination with petroleum-derived oils. The present invention is applicable to mixtures of biofuel and petroleum-derived fuels in any ratio. For example, at least 5%, preferably at least 25%, more preferably at least 50%, and most preferably at least 95% by weight of the oil, may be derived from a plant or animal source.

Synthetic base stock lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1 octenes), poly (1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs, and homologs thereof. Also useful are synthetic oils derived from a gas to liquid process from Fischer-Tropsch synthesized hydrocarbons, which are commonly referred to as gas to liquid or "GTL" base oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide and the alkyl and aryl ethers of polyoxyalkylene polymers (e.g., methylpolyisopropylene glycol ether having a molecular weight of 1000 or diphenyl ether of polyethylene glycol having a molecular weight of 1000 to 1500), and mono- and polycarboxylic esters thereof, for example, the acetic acid esters, mixed $C_3$-$C_8$ fatty acid esters, and $C_{13}$ oxo acid diester of tetraethylene glycol.

Another suitable class of synthetic base stock lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2 ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol. Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, poly-α-olefins, and the like.

Silicon-based oils such as the polyalkyl-, polyaryl-, polyalkoxy- or polyaryloxysilicone oils and silicate oils comprise another useful class of synthetic base stock lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

The lubricating oil may be derived from unrefined, refined, rerefined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a viscosity index of at least 130, preferably at least 135 or higher and, following dewaxing, a pour point of about −20° C. or lower.

The base stock of lubricating viscosity can comprise a Group I, Group II, or Group III base stock or base oil blends of the aforementioned base stocks. Preferably, the oil of lubricating viscosity is a Group II or Group III base stock, or a mixture thereof, or a mixture of a Group I base stock and one or more of a Group II and Group III. Preferably, a major amount of the oil of lubricating viscosity is a Group II, Group III, Group IV, or Group V base stock, or a mixture thereof. The base stock, or base stock blend, preferably has a saturate content of at least 65%, e.g., at least 75% or at least 85%. Most preferably, the base stock, or base stock blend, has a saturate content of greater than 90%.

Additionally, suitable fuels may include Fischer-Tropsch fuels. Fischer-Tropsch fuels, also known as FT fuels, include those described as gas-to-liquid (GTL) fuels, biomass-to-liquid (BTL) fuels and coal conversion fuels. To make such fuels, syngas ($CO+H_2$) is first generated and then converted to normal paraffins by a Fischer-Tropsch process. The normal paraffins can then be modified by processes such as catalytic cracking/reforming or isomerization, hydrocracking and hydroisomerization to yield a variety of hydrocarbons such as iso-paraffins, cyclo-paraffins and aromatic compounds. The resulting FT fuel can be used as such or in combination with other fuel components and fuel types. Also suitable are diesel fuels derived from plant or animal sources. These can be used alone or in combination with other types of fuel.

Preferably the volatility of the oil or oil blend, as measured by the Noack volatility test (ASTM D5880), is less than or equal to 30%, preferably less than or equal to 25%, more preferably less than or equal to 20%, most preferably less than or equal to 16%. Preferably, the viscosity index (VI) of the oil or oil blend is at least 85, preferably at least 100, most preferably from about 105 to 140.

Definitions for the base stocks and base oils in this invention are the same as those found in the American Petroleum Institute (API) publication "Engine Oil Licensing and Certification System," Industry Services Department (14th ed., December 1996), Addendum 1, Dec. 1998. This publication categorizes base stocks as follows.

(a) Group I base stocks contain less than 90 percent saturates (as determined by ASTM D 2007) and/or greater than 0.03 percent sulfur (as determined by ASTM D 2622, ASTM D 4294, ASTM D 4927 and ASTM D 3120) and have a viscosity index greater than or equal to 80 and less than 120 (as determined by ASTM D 2270).

(b) Group II base stocks contain greater than or equal to 90 percent saturates (as determined by ASTM D 2007) and less than or equal to 0.03 percent sulfur (as determined by ASTM D 2622, ASTM D 4294, ASTM D 4927 and ASTM D 3120) and have a viscosity index greater than or equal to 80 and less than 120 (as determined by ASTM D 2270).

(c) Group III base stocks contain greater than or equal to 90 percent saturates (as determined by ASTM D 2007) and less than or equal to 0.03 percent sulfur (as determined by ASTM D 2622, ASTM D 4294, ASTM D 4927 and ASTM D 3120) and have a viscosity index greater than or equal to 120 (as determined by ASTM D 2270).

(d) Group IV base stocks are polyalphaolefins (PAO).

(e) Group V base stocks include all other base stocks not included in Groups I, II, III, or IV.

Processes for Improving Friction Reducing Ability

The invention also relates to processes for improving the friction reducing ability of a lubricant. The process comprises releasing into the lubricant, e.g., base stock, a fatty acid sorbitan ester that is solid or semi-solid. In preferred embodiments, the fatty acid sorbitan ester is as described above in relation to the fatty acid sorbitan ester composition and the lubricant composition. In addition to the fatty acid sorbitan ester, additional additives may, preferably, be released into the lubricant. These additional lubricants may be those described above. As a result of the characteristics and properties of the fatty acid sorbitan ester and/or the additional lubricants, e.g., viscosity and/or solid or semi solid state, in preferred embodiments, the release of the fatty acid sorbitan ester and/or additional additives into the lubricant is at a controlled rate, e.g., a gradual rate. In preferred embodiments, the fatty acid sorbitan ester composition is released into the lubricant at a rate release rate not greater than about 0.5 grams per minute, e.g., not greater than about 0.15 grams per minute, not greater than about 0.10 gram per minute, not greater than about 0.075 grams per minute, not greater than about 0.05 grams per minute, not greater than about 0.03 grams per minute, not greater than about 0.025, not greater than about 0.01 grams per minute or not greater than 0.0025 grams per minute. In terms of ranges, the release rate optionally ranges from about 0.0001 to about 0.5 grams per minute, e.g., from about 0.0025 to about 0.15 grams per minute, from about 0.01 to about 0.15 grams per minute, from about 0.01 to about 0.1 grams per minute, from about 0.01 to about 0.05 grams per minute or from about 0.01 to about 0.025 grams per minute. The release rates may be measured at temperatures of at least 25° C., e.g., at least 50° C., at least 60° C., at least 70° C., at least 80° C., at least 90° C., at least 95° C., at least 105° C. or at least 120° C. In some embodiments, the fatty acid sorbitan ester composition is released into a lubricating composition slowly over a long period of time, such as the life of the lubricating composition, e.g., at least one day, at least one week, at least one month or at least one year. In other embodiments, the fatty acid sorbitan ester can be delivered into the base oil over the time between oil changes. For example, the fatty acid sorbitan ester may be delivered into the base oil over a mileage span of less than 20,000 miles, e.g., less than 15,000 miles, less than 10,000 miles, less than 8,000 miles, less than 5,000 miles, less than 3,000 miles or less than 1,000 miles.

As noted above, the gradual rate of release of fatty acid sorbitan ester composition into the lubricant, replenishes the lubricating properties of the lubricant that are lost over time. In preferred embodiments, the release of the fatty acid sorbitan ester composition is achieved by contacting the fatty acid sorbitan ester composition with the lubricant. Typically, the fatty acid sorbitan ester composition may be delivered by any means by which the fatty acid sorbitan ester composition can be brought into contact with the lubricant. The fatty acid sorbitan ester composition can be used in any lubricating conditioning device including, but not limited to, internal combustion engines, natural gas engines, stationary engines, marine diesel engines, power equipment, hydraulic systems, lubricated mechanical systems, transmission systems, gears, differentials, metal working coolant systems, industrial lubricated systems, compressors and the like. For example, in an engine related application, the contacting of the fatty acid sorbitan ester composition with the lubricant may be achieved via a container/delivery device can be placed in an oil filter or within an oil pan or within a fluid by-pass loop to contact the fatty acid sorbitan ester composition with the lubricant. In other embodiments, the fatty acid sorbitan ester composition may be located in a drain pan, an oil bypass loop, a canister, a housing, a reservoir, pockets of the filter, a canister in the filter, mesh in the filter, canister in a bypass system or mesh in a bypass system. Of course, these examples are not exclusive of other potential applications. In one embodiment, the fatty acid sorbitan ester composition is placed in one or more locations in the lubrication system. In another embodiment, more than one fatty acid sorbitan ester composition, e.g., different fatty acid sorbitan ester/additive combinations, can be utilized in a single system.

In preferred embodiments, the addition of the fatty acid sorbitan ester composition is dependent upon the desired form of the additive composition, the desired speed of addition, the desired release rate, the desired mode of operation and/or any of the combinations of the above. In one embodiment, the fatty acid sorbitan ester composition is semi-solid and is added to the lubrication system by means of an injector pump, or a container in an oil filter. In another embodiment, the fatty acid sorbitan ester composition is a solid and is introduced into the lubricating oil system by means of an auger.

Lubricating Device (Filter)

In view of the above, the invention also relates to a device for providing one or more fatty acid sorbitan esters and optionally one or more additives to a lubricant, e.g., to a base stock. The device comprises the fatty acid sorbitan ester composition, as discussed above, and a container for containing the fatty acid sorbitan ester composition. In preferred embodiments, the container is configured to have the lubricant flowing therethrough. With the lubricant flowing through the container, the lubricant may contact the fatty acid sorbitan ester composition, e.g., pass over and/or through the fatty acid sorbitan ester composition, thereby releasing the fatty acid sorbitan ester composition into the lubricant.

In preferred embodiments, the container is an oil filter. In one embodiment, the sugar based sorbitol moiety of the fatty acid sorbitan ester provides an affinity to a cellulosic material, which may be used as the filter media. In some embodiments, the oil filter comprises a housing, such as a sleeve or cup, that can be partitioned, for example with a non-diffusible barrier, thereby creating at least one pocket. Each pocket may comprise an identical, similar and/or a different release additive composition wherein the composition can be in an identical, similar and/or different form, such as a semi-solid or solid form. A non-limiting example of this concept includes one pocket comprising a fatty acid sorbitan ester composition in a solid form and a second pocket comprising a fatty acid sorbitan ester composition in a semi-solid form. In other embodiments, multiple pockets may comprise all solid or all semi-solid fatty acid sorbitan ester compositions and/or additives. In preferred embodiments, the filter is a desirable location to place the fatty acid sorbitan ester composition because the fatty acid sorbitan ester and/or spent additives may easily be removed and then replaced with a new and/or recycled fatty acid sorbitan ester composition. In yet another embodiment, the fatty acid sorbitan ester composition is located anywhere within the lubrication system. For example, the release additive can be located outside of an oil filter on the "dirty" side or it can be located inside of the oil filter on the "clean" side. One of ordinary skill in the art would understand that the location of the release additive in the lubrication system is not critical so long as the release additive composition is in contact with a lubricating composition.

EXAMPLES

Embodiments of the invention will become more evident in view of the following non-limiting examples.

Example 1

Preparation of Fatty Acid Sorbitan Esters

Fatty acid sorbitan esters were prepared under the following parameters.

Case 1

Excess 1,4 Sorbitol is reacted with tallow fatty acid (TFA) using a single step approach, under mild conditions without a catalyst for 12 hours. The TFA, Industrene 143, is charged into the 1,4-Sorbitol, Sorbitol 9033, at a mole ratio of 6:1 sorbitol:TFA. The reaction is kept at 180° C. for 12 hours. The yield is characterized by monitoring the FT-IR absorbance at 1739.6 cm-1 (Tallow-fatty acid sorbitan ester), and 1704

$cm^{-1}$ (Tallow Fatty acid). Although not a typical commercial process, mostly mono-ester is formed.

Case 2

The reaction of Case 1 is repeated at higher TFA levels—1:1 sorbitol:TFA mole ratio. The resultant product contained a greater concentration of the di-ester—at least 25% greater.

Case 3

An acidic catalyst is used with a sorbitol:TFA mole ratio of 6:1 and a temperature of 180° C. for 6 hrs. Although, as examples, sulfuric acid phosphoric acid, ($NaH_2PO_3$), p-toluenesulfonic acid and benzene sulfonic acid to may typically be used, methane sulfonic acid may also be used at a low treat rate of 0.1 wt. % and reacted for 6 hrs. The resultant product contained higher mono-ester concentration as compared with the product of the non-catalyzed reaction.

Case 4

A base catalyzed approach is used with potassium tert-butoxoide at 0.5 wt % and reacted for 6 hrs. at 180° C. with a sorbitol:TFA mole ratio of 6:1. This case may generate more mono-ester, thus, loadings closer to 1:1 sorbitol to TFA may be used. The resultant product contained higher mono-ester concentration.

Cases 5 and 6

A methane sulfonic acid and K-tert-butoxide catalyst respectively are run for 6 hrs with a 1:1 sorbitol:TFA mole ratio. Following these approaches, the use of transesterification of the methyl tallowate with sorbitan at lower temperatures may be performed in a two step process (see Cases 7 and 8, below).

Case 7

Tallow triglyceride is reacted under methanol reflux with KOH/MeOH to generate methyl Tallowate and glycerine, which is removed leaving clean Methyl-Tallowate. Following the generation of the methyl-Tallowate, a transesterification reaction at a 1:1 mole ratio (sorbitol:Methyl-Tallowate) may be carried out using potassium tert-butoxide catalyst 0.2% Wt. at 80° C. This approach is the less severe than higher temperature direct fatty acid esterification and generates a tallow sorbitan of a good light color.

Case 8

In order to form more mono-ester, the reaction is repeated with a 6:1 sorbitol:Methyl-Tallowate, again, with potassium tert-butoxide (0.2% Wt.). All catalyzed reaction products are treated to neutralize the existing catalyst which is then removed by filtration, aqueous washing is utilized to remove catalyst salts and unreacted sorbitol/sorbitan or isosorbide followed by stripping off the residual under vacuum.

Case 9

The assistance of dimethyl-formamide solvent is explored in Case 9. Tallow sorbitan was synthesized by first generating the methyl-tallowate ester, followed by a 1:1 mole ratio of Sorbitol to methyl-Tallowate dissolved in dimethyl formamide to assist in the reaction using 0.2% potassium tert-butoxide catalyst and reacting at 78° C.-82° C. under a moderate $N_2$ sparge to remove the methanol and light vacuum. This approach generates primarily mono-ester tallow sorbitan. In addition to reacting tallow fatty acid with 1,4-sorbitan, several reactions may be undertaken to react the methyl-Tallowate with Isosorbide using potassium tert-butoxide under house vacuum. The role of the methyl-tallowate and isosorbide is to generate blending stocks for developing a rage of hardness in the solid or semi-solid tallow sorbitan/isosorbide friction modifier.

Example 2

Friction Reducing Ability of Inventive TSE Compositions

A base stock, Excell 100 HC, was blended with 500 parts per million of TSE compositions A, B and C, the parts per million based on the total parts of the base stock. Composition A comprises TSE. Composition B comprises equal parts of TSE and HXL 7121. Composition C comprises equal parts of TSE and HXL 7353. The results of Cameron Plint friction testing (Coefficient of Friction, ("CoF"), data) are shown in TABLE 1 for Excell 100 HC, TSE, HXL 7121, and HXL 7353, individually; and for inventive combinations A, B and C.

TABLE 1

| Excell 100 HC without additives CoF | Excell 100 HC with TSE (A) CoF | Percent Red. (A) | Excell 100 HC with HXL 7121 CoF | Excell 100 HC with TSE and HXL 7121 (B) CoF | Percent Red. (B) | Excell 100 HC with HXL 7121 CoF | Excell 100 HC with TSE and HXL 7353 (C) CoF | Percent Red. (C) | Temp., ° C. |
|---|---|---|---|---|---|---|---|---|---|
| 0.112 | 0.078 | 30.4% | 0.078 | 0.08 | 28.6% | 0.079 | 0.078 | 30.4% | 60 |
| 0.117 | 0.079 | 32.5% | 0.081 | 0.078 | 33.3% | 0.09 | 0.077 | 34.2% | 70 |
| 0.118 | 0.079 | 33.1% | 0.093 | 0.076 | 35.6% | 0.098 | 0.077 | 34.7% | 80 |
| 0.117 | 0.082 | 29.9% | 0.103 | 0.075 | 35.9% | 0.097 | 0.077 | 34.2% | 90 |
| 0.113 | 0.085 | 24.8% | 0.105 | 0.075 | 33.6% | 0.094 | 0.078 | 31.0% | 100 |
| 0.112 | 0.088 | 21.4% | 0.099 | 0.076 | 32.1% | 0.09 | 0.078 | 30.4% | 110 |
| 0.112 | 0.087 | 22.3% | 0.094 | 0.069 | 38.4% | 0.083 | 0.078 | 30.4% | 120 |
| 0.112 | 0.087 | 22.3% | 0.089 | 0.066 | 41.1% | 0.08 | 0.069 | 38.4% | 130 |
| 0.113 | 0.096 | 15.0% | 0.086 | 0.063 | 44.2% | 0.079 | 0.069 | 38.9% | 140 |
| 0.116 | 0.105 | 9.5% | 0.087 | 0.062 | 46.6% | 0.079 | 0.072 | 37.9% | 150 |
| 0.123 | 0.112 | 8.9% | 0.088 | 0.063 | 48.8% | 0.077 | 0.071 | 42.3% | 160 |

The friction reduction capability of TSEs and various other additives at various temperatures is shown in TABLE 1. In preferred embodiments, the fatty acid sorbitan esters (without additional additives) reduce the coefficient of friction in the respective lubricant composition by at least 30%, as measured at temperatures less than or equal to 80° C.; and by at least 15%, as measured at temperatures less that or equal to 140° C. These results are surprising and unexpected because the fatty acid sorbitan esters of the present invention have not previously been utilized in friction reduction applications. Thus, there would be no expectation that the inventive fatty acid sorbitan ester composition would provide such superior results.

Also, as shown in TABLE 1, the friction reduction capability of tartrates (alone), as well as the consistency of that capability, is significantly improved with the addition of the inventive TSEs. The friction reduction capabilities of the tartrates is good at temperatures below 60° C., but decreases in the temperature range of 60° C.-110° C., e.g., the CoF of the lubricant composition increases over this temperature range. The friction reduction capabilities then increase again as temperatures exceed 110° C. Surprisingly and unexpectedly, the combination of the TSEs with these tartrates provides friction reduction that is consistent across the temperature range of 60° C. to 160° C. An increase in CoF over the temperature is not seen when the inventive compositions are utilized. This result could not have been expected based on the friction reduction capabilities of the tartrates and/or the TSEs.

Additionally, the TSEs and tartrates demonstrate a synergistic effect when utilized in combination with one another, i.e., the actual effect of the TSE/tartrate combination is greater than the expected effect of the TSE and the tartrate at temperatures greater than 60° C., e.g., greater than 80° C., greater than 90° C., greater than 120° C. or greater than 140° C. The combination of TSE and tartrate reduces the coefficient of friction of the lubricant composition to below 0.1, e.g., below 0.8, below 0.75, below 0.7 or below 0.6, at temperatures greater than 60° C., e.g., greater than 80° C., greater than 90° C., greater than 120° C. or greater than 140° C. In terms of percentages, the combination of TSE and tartrate reduces the coefficient of friction of the lubricant composition by at least 50%, e.g., at least 40%, at least 30% or at least 25%, at temperatures greater than 60° C., e.g., greater than 80° C., greater than 90° C., greater than 120° C. or greater than 140° C., when compared to a lubricant composition that contains no additives. These reductions are significantly lower than would be expected based on the individual CoFs for TSEs and tartrates alone. Thus, the friction reducing ability of the inventive combinations is surprising and unexpected.

Example 3

Controlled Release of Inventive TSE Compositions

Figure 2:
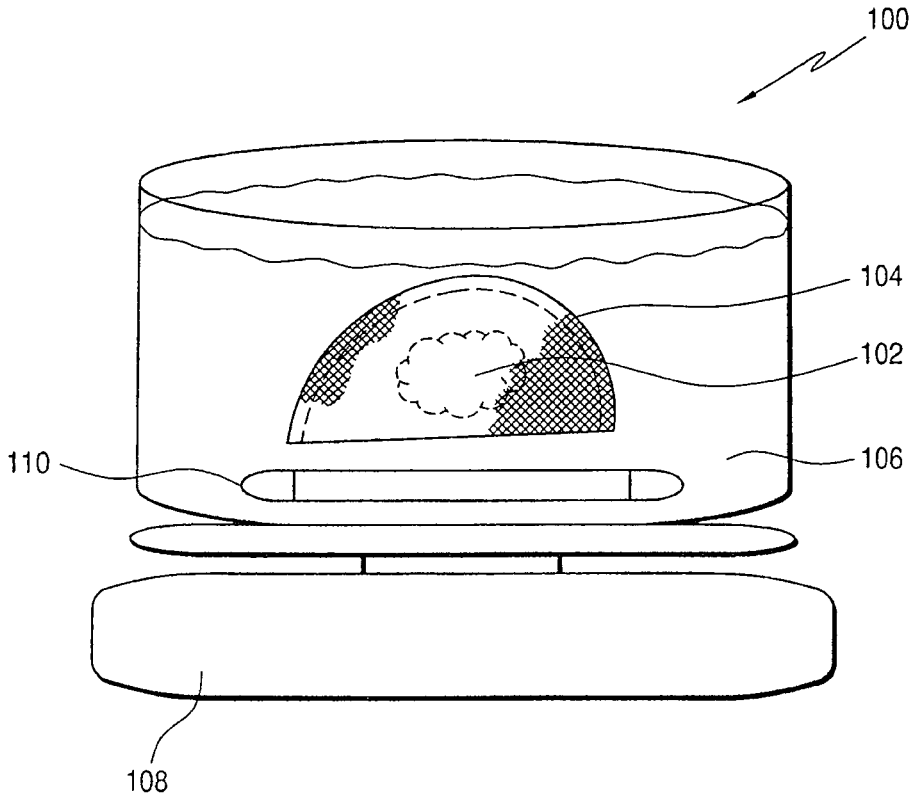
FIG. 2 is a front view also in cross section of an exemplary system utilized to evaluate the release rate of a friction modifier composition in to a base stock.

An exemplary system 100 for evaluating the release rate of a friction modifier composition in to a base stock is shown in FIG. 2. TSE composition 102, which was prepared in accordance with the present invention, was contained in Whatman-42 filter paper folded envelope 104. Envelope 104 was placed in base stock 106, e.g., Group III base oil, heated to 95° C. using heating element 108, while stirring with stir bar 110 to simulate lubricant flow through a filter pouch. Base stock 106 was maintained at 95° C. and continuously stirred for 5 hours. The lubricant composition was analyzed via Fourier Transform Infared Spectorscopy (FT-IR). The weight of the friction modifier was measured, at time intervals indicated below, by removing the envelope and patting the envelope dry with Kim-wipe towels, then weighing the envelope. The results of the testing are shown in TABLE 2.

TABLE 2

| Slow Release Spectra | FT-IR Peak Height | TSE Weight, grams | Time, minutes |
|---|---|---|---|
| VHVI-4 | 0.0012 | 19.9 | 0 |
| FM1 | 0.00295 | 19.3 | 15 |
| FM2 | 0.00364 | 18.8 | 30 |
| FM3 | 0.00401 | 18.5 | 45 |
| FM4 | 0.00432 | 18.4 | 60 |
| FM5 | 0.00448 | 17.2 | 75 |
| FM6 | 0.00585 | 15.7 | 105 |
| FM7 | 0.00595 | 14.1 | 115 |
| FM8 | 0.00643 | 13.4 | 145 |
| FM9 | 0.00651 | 13.5 | 175 |
| FM10 | 0.00701 | 13.5 | 205 |
| FM11 | 0.00758 | 12.7 | 235 |
| FM12 | 0.00789 | 12.6 | 265 |
| FM13 | 0.00831 | 11.7 | 295 |

As shown in TABLE 2, the FT-IR peak heights, which are indicative of the quantity of TSE in the lubricant composition, gradually increase over time, e.g., the TSE is controllably released into the lubricant composition. This conclusion is also supported by the weight measurements of the envelope containing the TSE. Over the 295 minute period, 8.2 grams of TSE was released from the envelope and into the lubricant. It is noted that there is an error range in the weight measurement of approximately 0.2 grams. This explains the alleged increase in weight measurements at 145 and 175 minutes.

The controlled release, e.g., slow release, of the TSE into the lubricant is demonstrated in FIG. 1, which shows the growth of the 1742 $cm^{-1}$ wavelength. The growth of this peak over time is indicative of the increase in TSE in the lubricant over time. As the size of the peak increases, the amount of TSE in the lubricant increases.

Any feature described or claimed with respect to any disclosed implementation may be combined in any combination with any one or more other feature(s) described or claimed with respect to any other disclosed implementation or implementations, to the extent that the features are not necessarily technically incompatible, and all such combinations are within the scope of the present invention. Furthermore, the claims appended below set forth some non-limiting combinations of features within the scope of the invention, but also contemplated as being within the scope of the invention are all possible combinations of the subject matter of any two or more of the claims, in any possible combination, provided that the combination is not necessarily technically incompatible.

What is claimed is:

1. A device for providing additives to a lubricant, the device comprising:

a solid or semi-solid solid mixture of fatty acid sorbitan esters represented by general formula:

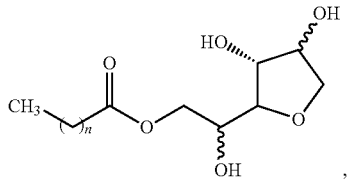

, wherein n ranges from 6 to 22; and a container for holding the fatty acid sorbitan ester, the container being configured to allow the lubricant to flow therethrough;

wherein the device is configured to allow the lubricant to pass over and/or through the fatty acid sorbitan ester causing the fatty acid sorbitan ester to be released into the lubricant at a rate ranging from about 0.0025 grams per minute to about 0.15 grams per minute.

2. The device of claim 1, wherein the mixture of fatty acid sorbitan esters is a mixture of tallow fatty acid sorbitan esters and/or coconut fatty acid sorbitan esters.

3. The device of claim 1, wherein the esters in the mixture of fatty acid sorbitan esters are fully saturated.

4. The device of claim 1, wherein the container is an oil filter.

5. The device of claim 2, wherein the container is an oil filter.

6. The device of claim 3, wherein the container is an oil filter.

7. The device of claim 2, wherein the mixture of fatty acid sorbitan esters is a mixture of tallow fatty acid sorbitan esters.

* * * * *